US005433373A

United States Patent [19]

Zoeller

[11] Patent Number: 5,433,373

[45] Date of Patent: Jul. 18, 1995

[54] CARRIERS FOR SUPPORTING AND TRANSPORTING SHOWER RELATED ITEMS

[76] Inventor: Kenneth M. Zoeller, c/o Sandy Harbin, 7700 Sierra Trail, Louisville, Ky. 40214

[21] Appl. No.: 215,103

[22] Filed: Mar. 21, 1994

[51] Int. Cl.[6] ..... B65D 5/475

[52] U.S. Cl. ..... 229/117.26; 229/120.07; 229/120.38; 294/146; 294/160

[58] Field of Search ..... 229/117.19, 117.23, 229/117.26, 904, 198.1, 161, 120.07, 120.38; 220/759, 760, 767, 773; 294/146, 159, 160

[56] References Cited

U.S. PATENT DOCUMENTS

| | | | |
|---|---|---|---|
| 2,734,349 | 2/1956 | Repking et al. | 229/120.28 X |
| 2,895,609 | 7/1959 | Royotte | 294/146 X |
| 2,897,974 | 8/1959 | Cook | 294/146 X |
| 3,270,939 | 9/1966 | Ebelhardt | 229/117.26 X |
| 3,477,633 | 11/1969 | Greene et al. | 229/117.19 |
| 4,126,265 | 11/1978 | Holmes | 229/198.1 X |
| 4,685,559 | 8/1987 | Titus | 294/146 X |
| 4,938,413 | 7/1990 | Wolfe | 229/939 X |
| 5,037,027 | 8/1991 | Nichols | 229/198.1 |
| 5,209,394 | 5/1993 | Griffiths et al. | 229/117.23 X |

FOREIGN PATENT DOCUMENTS

| | | | |
|---|---|---|---|
| 380555 | 9/1932 | United Kingdom | 229/117.19 |

*Primary Examiner*—Allan N. Shoap
*Assistant Examiner*—Christopher J. McDonald

[57] ABSTRACT

A carrier for supporting and transporting shower related items comprising of a first major sheet of a semi-rigid plastic material, such sheet having a centrally disposed rectangular region constituting the base of the device, the base having parallel side edges and parallel front and rear edges formed by primary fold lines, rectangular end panels formed with the base on the sides thereof remote from the primary fold lines, the end panels extending laterally to form side panels and separated therefrom by secondary fold lines, the sheet adapted to have the end panels folded upwardly from the base at the primary fold lines and to have the side panels folded inwardly along the secondary fold lines to thereby form a rectangular shaped container with a closed lower surface and an open upper surface. A pair of insert panels of a semi rigid plastic material, each of the insert panels being formed with parallel side edges and parallel end edges, the side edges being of a narrow configuration at their interior sides and of an enlarged configuration at their horizontal upper extents with a central fold line parallel with the end edges extending between the upper and lower extents, the insert panels being formed with a pair of apertures extending therethrough in the wide extent. A strap of a semi rigid plastic material in an elongated rectangular configuration with slots at the ends for coupling with respect to the side panels. Tabs and apertures formed on the major sheet and insert panels for coupling together the major sheet, insert panels and strap to form a carrier device.

1 Claim, 4 Drawing Sheets

CARRIERS FOR SUPPORTING AND TRANSPORTING SHOWER RELATED ITEMS

BACKGROUND OF THE INVENTION

1. Field of the Invention

The present invention relates to carriers for supporting and transporting shower related items and more particularly pertains to supporting shower related components and transporting them in a convenient carrier.

2. Description of the Prior Art

The use of devices for supporting shower related components and for their transportation is known in the prior art. More specifically, devices for supporting shower related components and for their transportation heretofore devised and utilized for the purpose of supporting items and transport them in a carrier are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,180,067 to Conaway et al. a shower caddy.

U.S. Pat. No. 3,923,162 to Hussey discloses a shower caddy.

U.S. Pat. No. Des. 315,840 to Emery the design of a shower caddy.

U.S. Pat. No. Des. 292,256 to Chap the design of a shower caddy.

U.S. Pat. No. Des. 288,510 to Shames et al. the design of a shower caddy.

In this respect, the carriers for supporting and transporting shower related items according to the present invention substantially departs from the conventional concepts and designs of the prior art, and in doing so provides an apparatus primarily developed for the purpose of supporting shower related components and transporting them in a convenient carrier.

Therefore, it can be appreciated that there exists a continuing need for new and improved carriers for supporting and transporting shower related items which can be used for supporting shower related components and transporting them in a convenient carrier. In this regard, the present invention substantially fulfills this need.

SUMMARY OF THE INVENTION

In view of the foregoing disadvantages inherent in the known types of devices for supporting shower related components and for their transportation now present in the prior art, the present invention provides an improved carriers for supporting and transporting shower related items. As such, the general purpose of the present invention, which will be described subsequently in greater detail, is to provide a new and improved carriers for supporting and transporting shower related items and method which has all the advantages of the prior art and none of the disadvantages.

To attain this, the present invention essentially comprises a first major sheet of a semi-rigid plastic material, such sheet having a centrally disposed rectangular region constituting the base of the device, the base having parallel side edges and parallel front and rear edges formed by primary fold lines, rectangular end panels formed with the base on the sides thereof remote from the primary fold lines, the end panels extending laterally to form side panels and separated therefrom by secondary fold lines, the sheet adapted to have the end panels folded upwardly from the base at the primary fold lines and to have the side panels folded inwardly along the secondary fold lines to thereby form a rectangular shaped container with a closed lower surface and an open upper surface. A pair of insert panels of a semi rigid plastic material, each of the insert panels being formed with parallel side edges and parallel end edges, the side edges being of a narrow configuration at their interior sides and of an enlarged configuration at their horizontal upper extents with a central fold line parallel with the end edges extending between the upper and lower extents, the insert panels being formed with a pair of apertures extending therethrough in the wide extent. A strap of a semi rigid plastic material in an elongated rectangular configuration with slots at the ends for coupling with respect to the side panels. Tabs and apertures formed on the major sheet and insert panels for coupling together the major sheet, insert panels and strap to form a carrier device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved carriers for supporting and transporting shower related items which have all the advantages of the prior art devices for supporting shower related components and for their transportation and none of the disadvantages.

It is another object of the present invention to provide new and improved carriers for supporting and transporting shower related items which may be easily and efficiently manufactured and marketed.

It is further object of the present invention to provide new and improved carriers for supporting and transporting shower related items which are of durable and reliable constructions.

An even further object of the present invention is to provide new and improved carriers for supporting and transporting shower related items which are susceptible of a low cost of manufacture with regard to both materials and labor, and which accordingly are then susceptible of low prices of sale to the consuming public, thereby making such carriers for supporting and transporting shower related items economically available to the buying public.

Still yet another object of the present invention is to provide new and improved carriers for supporting and transporting shower related items which provide in the apparatuses and methods of the prior art some of the advantages thereof, while simultaneously overcoming some of the disadvantages normally associated therewith.

Still another object of the present invention is to supporting shower related components and transporting them in a convenient carrier.

Lastly, it is an object of the present invention to provide new and improved carrier for supporting and transporting shower related items comprising of a first major sheet of a semi-rigid plastic material, such sheet having a centrally disposed rectangular region constituting the base of the device, the base having parallel side edges and parallel front and rear edges formed by primary fold lines, rectangular end panels formed with the base on the sides thereof remote from the primary fold lines, the end panels extending laterally to form side panels and separated therefrom by secondary fold lines, the sheet adapted to have the end panels folded upwardly from the base at the primary fold lines and to have the side panels folded inwardly along the secondary fold lines to thereby form a rectangular shaped container with a closed lower surface and an open upper surface. A pair of insert panels of a semi rigid plastic material, each of the insert panels being formed with parallel side edges and parallel end edges, the side edges being of a narrow configuration at their interior sides and of an enlarged configuration at their horizontal upper extents with a central fold line parallel with the end edges extending between the upper and lower extents, the insert panels being formed with a pair of apertures extending therethrough in the wide extent. A strap of a semi rigid plastic material in an elongated rectangular configuration with slots at the ends for coupling with respect to the side panels. Tabs and apertures formed on the major sheet and insert panels for coupling together the major sheet, insert panels and strap to form a carrier device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
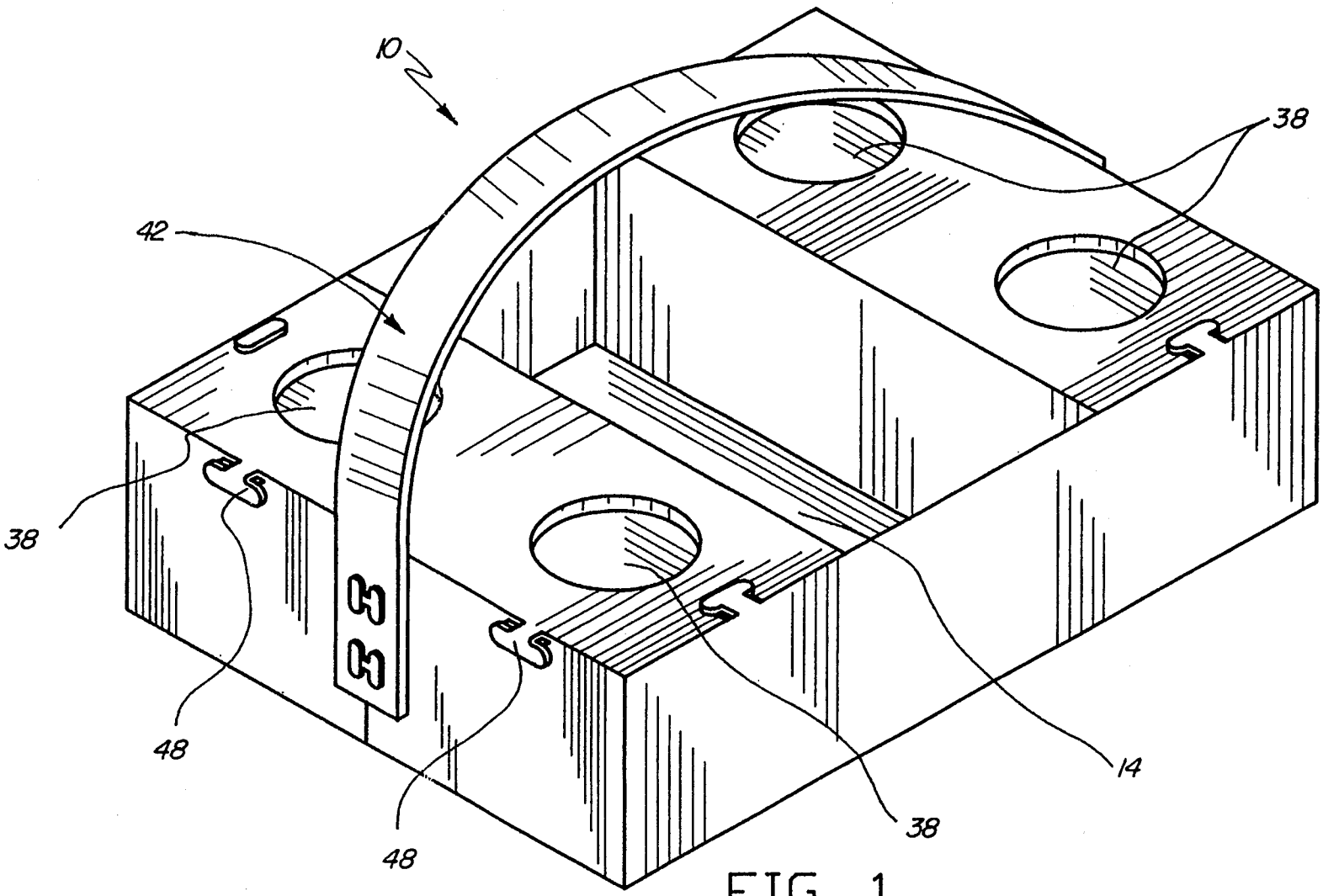
FIG. 1 is a perspective illustration of the preferred embodiment of the new and improved carrier for supporting and transporting shower related items constructed in accordance with the principles of the present invention.
Figure 2:
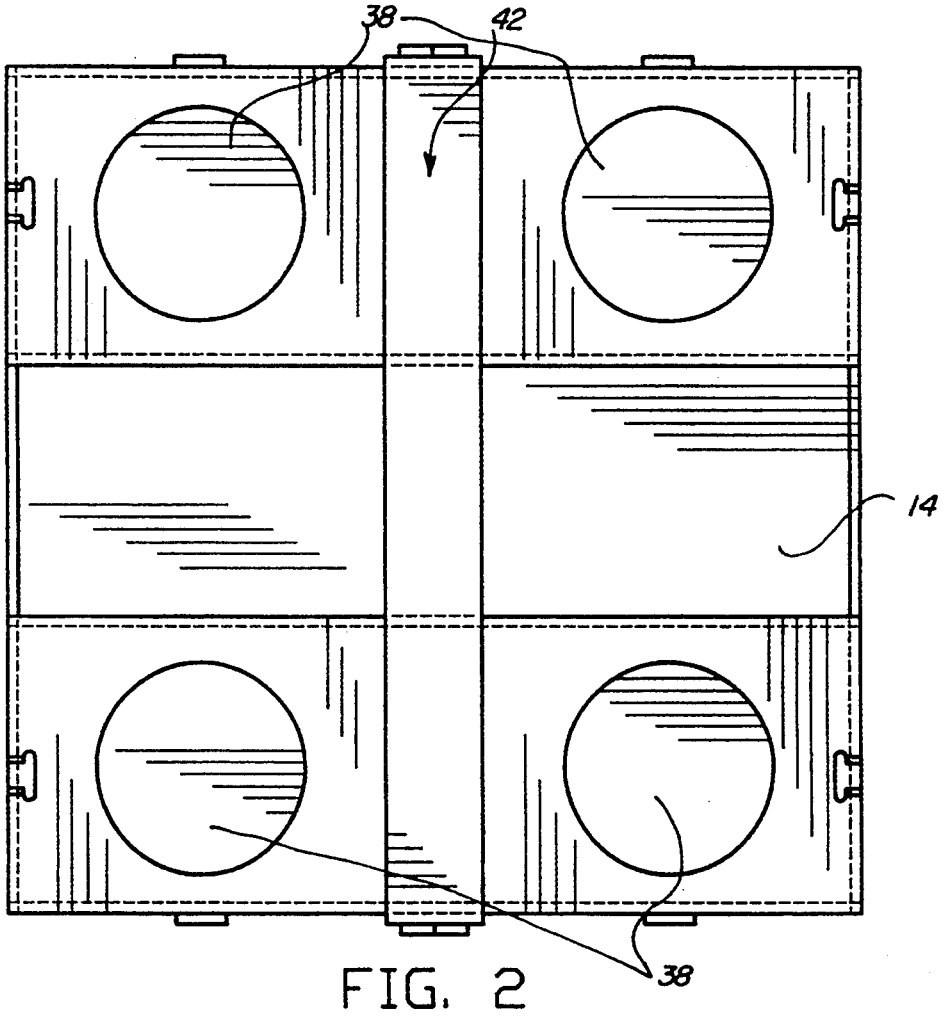
FIG. 2 is a plan view illustrating the carrier shown in FIG. 1.
Figure 3:
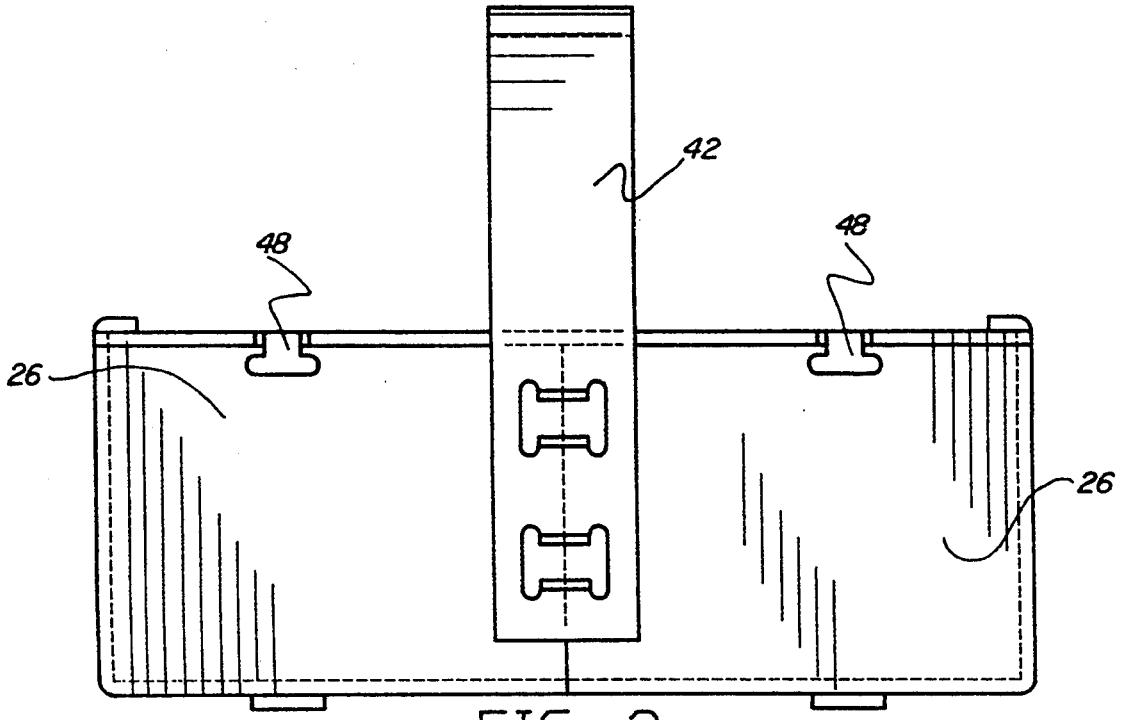
FIG. 3 is a side elevational view of the carrier shown in FIGS. 1 and 2.
Figure 4:
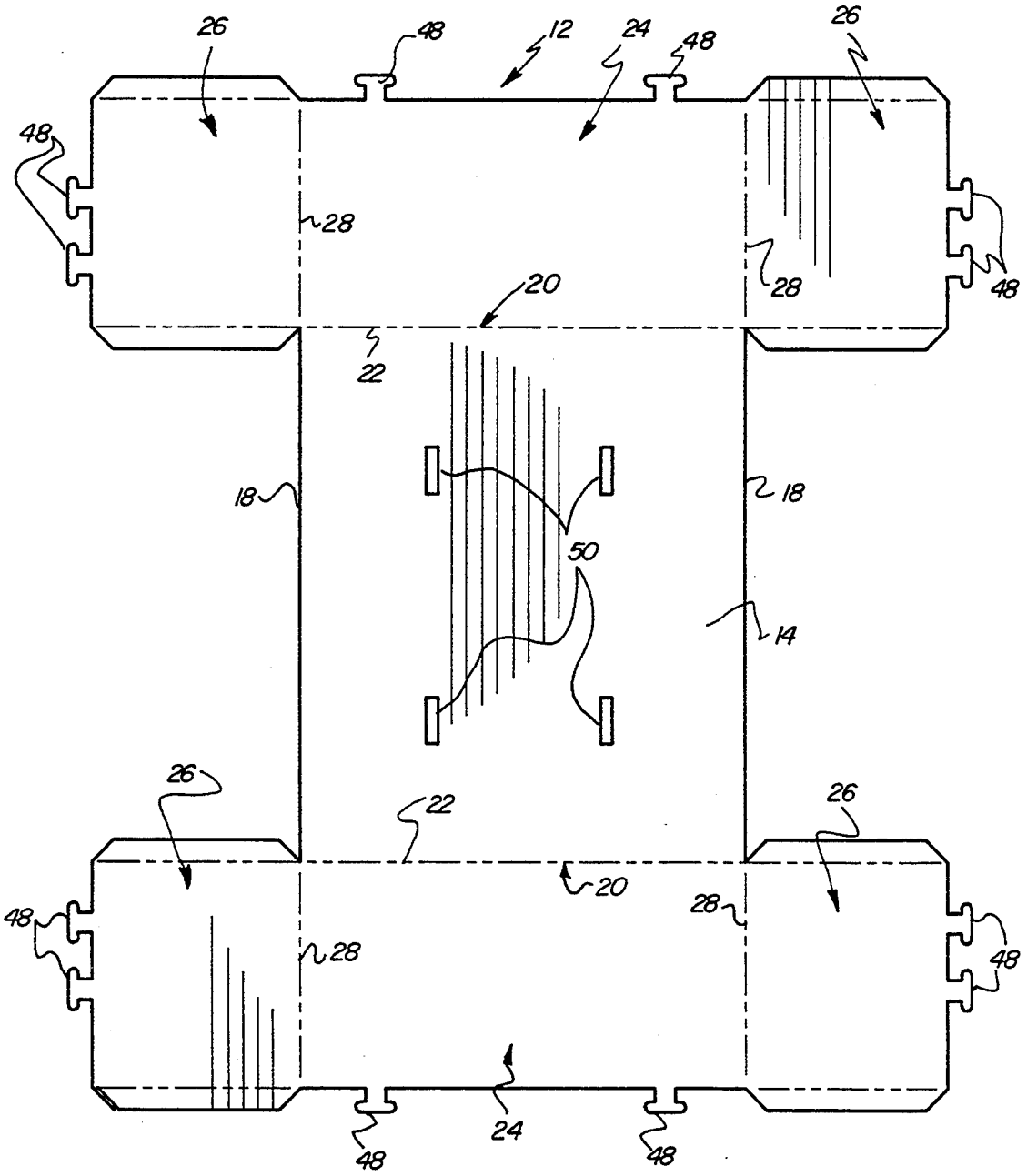
FIG. 4 is a plan view of the major component from which the device of the prior Figures is constructed.
Figure 5:
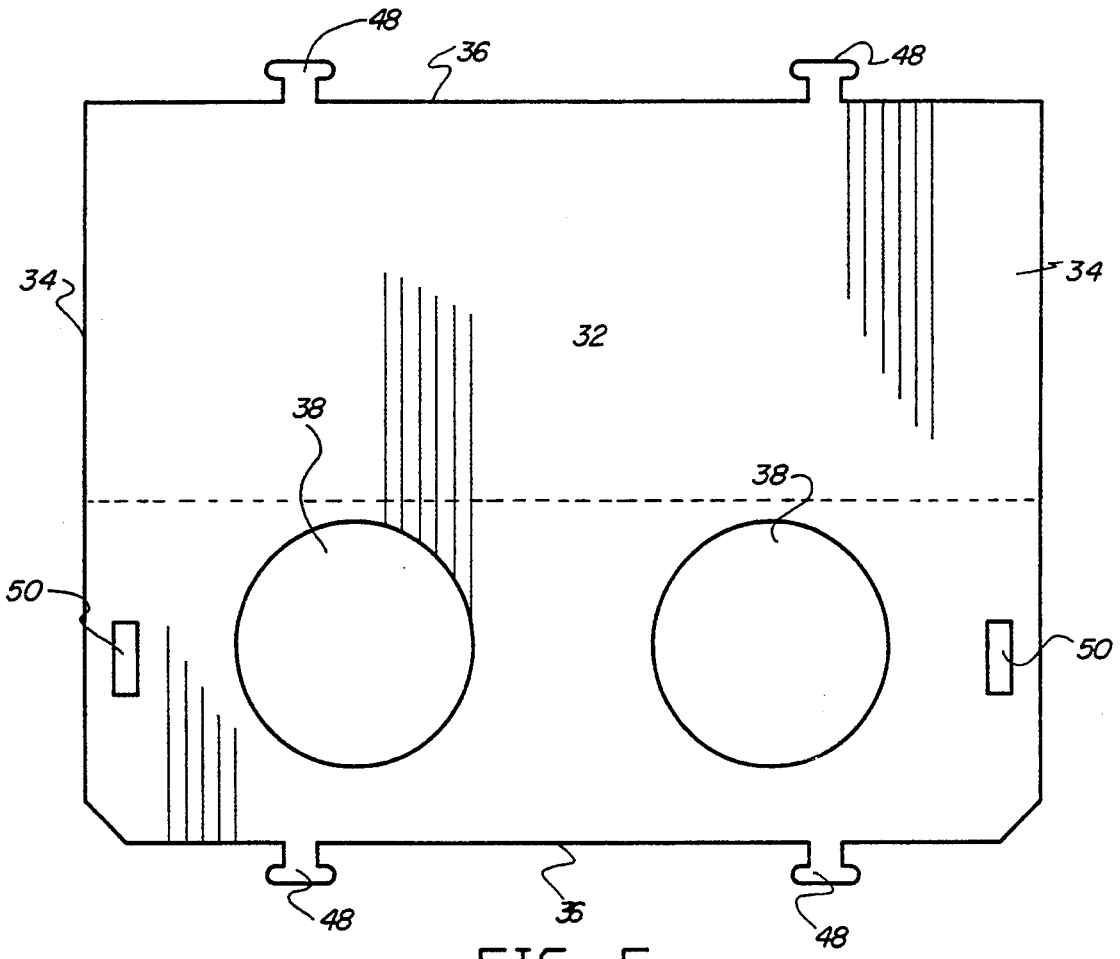
FIG. 5 is a plan view of one of two insert components utilized in association with the major component shown in FIG. 4 in constructing the device of the prior Figures.
Figure 6:
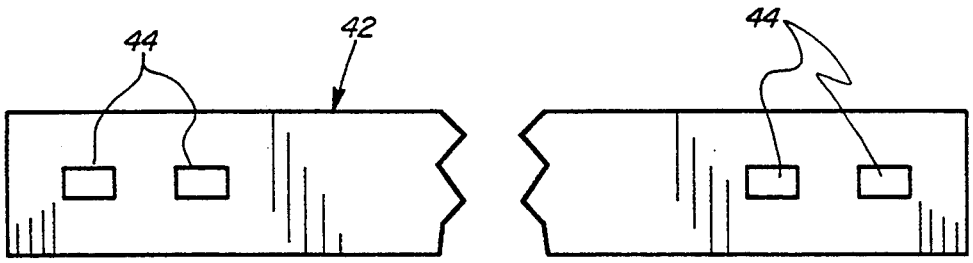
FIG. 6 is a plan view of the handle utilized in association with the components of FIGS. 4 and 5 in fabricating the device as shown in FIGS. 1, 2 and 3.

With reference now to the drawings, and in particular to FIG. 1 thereof, the preferred embodiment of the new and improved carriers for supporting and transporting shower related items embodying the principles and concepts of the present invention and generally designated by the reference numeral 10 will be described.

The present invention, the new and improved carrier for supporting and transporting shower related items is comprised of a plurality of components. In their broadest context, such components include a first major sheet, a pair of insert panels, a strap and tabs and apertures formed in the various components for the coupling therebetween to form a carrier device. The individual components are specifically configured and correlated with respect to each other so as to attain the desired objectives.

More specifically, the primary component of the carrier device is a first major sheet 12. Such sheet is fabricated of a semi-rigid plastic material. It has a centrally disposed rectangular region constituting the base 14 of the device 10 when assembled.

The base has parallel side edges 18 and parallel front and rear edges 20. The front and rear edges are formed by primary fold lines 22. Rectangular end panels 24 are formed with the base on the sides thereof remote from the primary fold lines. The end panels then extend laterally to form side panels 26. The side panels are separated from the end panels by secondary fold lines 28.

The first major sheet is adapted to have the end panels folded upwardly from the base at the primary fold lines and then to have the side panels folded inwardly toward each other adjacent to secondary fold lines overlying the side edges of the base. In this manner, the first major sheet thereby forms a rectangularly shaped container with a closed lower surface and an open upper surface.

The next major component of the carrier device is a pair of insert panels 32. Like the first major sheet, the insert panels are fabricated of a semi-rigid plastic material. Each of the insert panels are formed with parallel side edges 34 and parallel end edges 36. The side edges are of a narrow configuration at their vertical lower extents and of a wide configuration at their horizontal upper extents. A central fold line is provided parallel with the end edges and extends between and separates the upper and lower extents of the panels. The insert panels are formed with a pair of apertures 38 extending therethrough in the wide extent. This is to allow the carrying of bottles therein when the carrier device is fully constructed.

Next provided is a strap 42. The strap is also fabricated of a semi-rigid plastic material. It is in an elongated rectangular configuration with slots 44 adjacent to the end thereof for coupling with respect to the side panels of the first major sheet.

Lastly, there are provided a plurality of tabs 48 and associated apertures 50 which may be coupled with respect to each other. Such tabs are formed on the major sheet and insert panels for coupling together the major sheet, insert sheet and strap to form the carrier device.

People who are incarcerated in prisons face day-to-day problems that most people never have to think about. An example of this is when showering, and since cells are generally not equipped with showers, the inmates must to a public shower. They must have a way to carry supplies such as shampoo, soap and shaving cream with them. Some may use a conventional shaving bag for this purpose, but these can be left open and the lining can mildew. Some inmates make boxes to carry the supplies in the prison wood shop or sheet metal shop, and they may even sell some to other prisoners. However, these boxes are often confiscated during contraband searches because prison authorities consider them to be dangerous weapons in the hands of convicted felons.

The present invention provides a way for inmates to carry their shower supplies in a manner that will not be considered a threat to safety by prison authorities. The present invention is a simple plastic box. It consists of four parts, is easy to assemble, and includes a handle to make it more portable. It includes spaces for four bottles with a large open space in the middle for miscellaneous items such as soap, wash cloths and shaving materials.

Prisoners can buy the present invention in the prison commissary, and assemble the four pieces themselves. They can then carry the assembled device with them to shower. This would make an easy, convenient and safe way to transport their supplies.

The present invention should appeal to both prisoners and prison authorities as a useful solution to the problem of carrying shower supplies. The carriers for supporting and transporting shower related items could also be used in locker rooms, dormitories, or military barracks for somewhat similar purposes.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved carrier for supporting and transporting shower related items comprising, in combination:

a first major sheet of a semi-rigid plastic material, such sheet having a centrally disposed rectangular region constituting the base of the device, the base having parallel side edges and parallel front and rear edges formed by primary fold lines, rectangular end panels formed with the base on the sides thereof remote from the primary fold lines, the end panels extending laterally to form side panels and separated therefrom by secondary fold lines, the sheet having the end panels folded upwardly from the base at the primary fold lines and having the side panels folded inwardly along the secondary fold lines to thereabout form a rectangular shaped container with a closed lower surface and an open upper surface;

a pair of insert panels formed with parallel side edges and parallel end edges, a central fold line parallel with the end edges separating each insert panel into an upper horizontal extent and a lower vertical extent, the side edges being of a lesser length at their horizontal extents and of a greater length at their vertical extents with the insert panels each being formed with a pair of apertures extending therethrough in the horizontal extent;

a strap of a semi rigid plastic material in an elongated rectangular configuration with slots at the ends, each slot for coupling with respect to the side panels; and tabs and apertures formed on the major sheet and insert panels for coupling together the major sheet, insert panels and strap to form a carrier device with each side panel in contact with one end panel and the side panels spaced to form a space between the side panels.

* * * * *